US006727213B2

(12) United States Patent
Wäschenbach et al.

(10) Patent No.: US 6,727,213 B2
(45) Date of Patent: Apr. 27, 2004

(54) COMPOSITION FOR USE IN A DISHWASHER

(75) Inventors: Guido Wäschenbach, Oakland, NJ (US); Harald Magg, Ladenburg (DE); Richard Neergaard, Brussels (BE); Enric Carbonell, Barcelona (ES); Ralf Wiedemann, Griesheim (DE)

(73) Assignee: Reckitt Benckiser N.V., Hoofddorp (NL)

( * ) Notice: Subject to any disclaimer, the term of this patent is extended or adjusted under 35 U.S.C. 154(b) by 0 days.

(21) Appl. No.: 10/184,765

(22) Filed: Jun. 28, 2002

(65) Prior Publication Data

US 2003/0060393 A1 Mar. 27, 2003

Related U.S. Application Data

(63) Continuation of application No. PCT/EP00/13276, filed on Dec. 27, 2000.

(30) Foreign Application Priority Data

Dec. 29, 1999 (DE) ..... 199 63 569

(51) Int. Cl.[7] ..... C11D 17/00

(52) U.S. Cl. ..... 510/224; 510/227; 510/228; 510/229; 510/230; 510/446

(58) Field of Search ..... 510/224, 227, 510/228, 229, 230, 446

(56) References Cited

U.S. PATENT DOCUMENTS 5,972,870 A 10/1999 Anderson
6,264,985 B1 * 7/2001 Cremer ..... 424/473
6,514,429 B1 * 2/2003 Waschenbach et al. ..... 252/181

FOREIGN PATENT DOCUMENTS

| | | | |
|---|---|---|---|
| DE | 38 33 047 | C2 | 12/1993 |
| DE | 198 17 964 | A1 | 10/1999 |
| DE | 198 34 180 | A1 | 2/2000 |
| DE | 199 22 578 | A1 | 11/2000 |
| EP | 0 481 547 | A1 | 4/1992 |
| EP | 0 851 024 | A2 | 7/1998 |
| JP | 61-28440 | A | 2/1986 |
| JP | 09175992 | A2 * | 7/1997 |
| WO | WO 99/24550 | A1 | 5/1999 |
| WO | WO 99/27063 | A1 | 6/1999 |
| WO | WO 99/27064 | A1 * | 6/1999 |
| WO | WO 99/27067 | A1 * | 6/1999 |
| WO | WO 99/27069 | A1 | 6/1999 |

* cited by examiner

*Primary Examiner*—Lorna M. Douyon
(74) *Attorney, Agent, or Firm*—Akin Gump Strauss Hauer & Feld LLP

(57) ABSTRACT

A composition for use in a dishwasher is characterized by a base composition in the form of a tablet which becomes active substantially during the main wash cycle of the dishwasher. At least one separate zone in or on the tablet is provided with a substance that becomes active substantially during the rinse cycle of the dishwasher and with at least one substance that prevents lime scale build-up in the dishwasher and/or on the washed articles. The composition further includes agents that guarantee that at least the substance that becomes active substantially during the rinse cycle of the dishwasher is at least mainly released at the beginning of the rinse cycle at the earliest.

27 Claims, 2 Drawing Sheets

COMPOSITION FOR USE IN A DISHWASHER

CROSS-REFERENCE TO RELATED APPLICATIONS

This application is a continuation of International Application No. PCT/EP00/13276, filed Dec. 27, 2000, the disclosure of which is incorporated herein by reference.

BACKGROUND OF THE INVENTION

The present invention relates to a composition for use in a dishwasher.

Although modern dishwashers usually have a plurality of washing programs which differ in terms of the duration and temperature of the individual washing cycles, all essentially consist of the following basic steps: pre-rinse cycle, main washing cycle; one or more intermediate rinse cycles; a final rinse cycle; and drying. During the course of a dishwasher program, a series of products is metered into the dishwasher to assist the respective stage of the cycle. For example, the actual dishwasher detergent intended to provide the cleaning action is added at the start of the main washing cycle.

Special substances are used during the final rinse cycle, e.g. rinse agents. The purpose of rinse agents is to prevent drops of water from being left on the rinsed items as they are rinsed with water, which would otherwise leave behind specks of the substances dissolved/dispersed in the drops, in particular salts, after drying.

In addition to rinse agents, other substances may be used, which become active during the final rinse cycle, e.g. produce an anti-bacterial action (e.g. cationic compounds or triclosan), protect silver (e.g. benzotriazol), impart fragrance (fragrances, perfume), add bleaching/disinfecting action (e.g. chlorine bleaches), neutralize odors (e.g. polyvinyl pyrrolidone), means of removing deposits and enzymes (e.g. lipase for removing fatty deposits from the washed articles).

It is known that alkaline cleansing agent mixtures must be used in the dishwasher in conjunction with softened mains water to prevent lime scale on the machine parts and washed articles. Mains water is softened in the dishwasher by means of an ion exchange. A special device of the dishwasher must be regularly filled with salt, e.g. sodium chloride, in order to regenerate the ion exchanger.

If a dishwasher were to be operated without ion exchanger or without the onerous routine of topping up salt, it would be necessary to find an effective way of preventing lime scale or similar deposits.

One solution is to use an acid mixture of cleaning agents. This being the case, it will be possible to operate with hard mains water and dispense with the use of an ion exchanger in the dishwasher altogether, which would then obviate the need to top up the regenerating salt. The pH value of this cleanser would cause a shift in the carbonate-bicarbonate equilibrium so that bicarbonate, which does give rise to said deposits, would predominate. German patent specification DE 38 33 047 C2, for example, describes a powdered, acid dishwasher agent with a base of non-ionic surfactants, the 0.5 to 0.7%-strength aqueous solution of which has a pH value of from 2 to 6 and renders the use of an ion exchanger superfluous. The builders used in this case are hydroxycarboxylic acids, e.g. citric acid, and the chelating agents nitrilo-triacetic acid (NTA) and ethylene diamine triacetic acid (EDTA). A significant disadvantage of this cleanser formula is the unsatisfactory cleaning power, which is attributable in particular to the lack of alkalinity, especially on starch-based dirt.

To date, it has not been possible to combine or unite the cleaning function, the functions of the substances added during the final rinse cycle and the function of preventing lime scale if using hard water and alkaline cleansing agents in one product in a manner which obviates the need for an ion exchanger and the associated regeneration thereof, while obtaining performance that is as consistent as possible with the results achievable by separate metering. The underlying aim of the present invention was to unite the three above-mentioned functions in a single product, so that the user is required to place the product in the dishwasher in a one-off dose only.

A dishwasher cleaning tablet is known from patent specification EP 0 851 024 A2, which is intended to enable a controlled release of the functional ingredients into the rinsing cycle. The tablet comprises two layers, the first layer generating a pH value of from 8.5 to 11 in the washing water on dissolving, and the second layer a pH value of from 6.5 to 9. With this two-layered tablet, it is allegedly possible to delay the dispensing of special ingredients, in particular an acid source, a deposit-removing agent and surface active substances, until the final rinse cycle of the dishwasher. This being the case, the components of the second layer are embedded in a continuous medium which does not melt to release the components until the final rinse cycle. This temperature-dependent system has not proven itself in practice, in particular because controlled release of the components of the second layer as late as the final rinse cycle does not work reliably because of the likewise high temperatures during the main washing cycle, thereby preventing satisfactory cleaning results. The temperature program most widely selected by European consumers operates at the same temperature during the main washing cycle as in the final rinse cycle. This causes the active substances to be released from the second layer prematurely. Furthermore, the waxes used as the base for the second layer often form residues in the machine and on the washed articles.

BRIEF SUMMARY OF THE INVENTION

Against the background of the prior art outlined above, the underlying objective of the invention is to propose a composition which combines the cleaning function, the functions of the substances to be added during the final rinse cycle and the function of preventing lime scale if using hard water, these functions being activated at fixed times during a dishwasher rinse cycle, i.e. appropriate functional substances are released in a controlled manner during the dishwasher rinse cycle.

This objective is achieved by the invention in the form of an alternative to the generic composition, which is characterized by a base composition in the form of a tablet which becomes active substantially in the main washing cycle of the dishwasher; at least one region arranged separately in or on the tablet contains both at least one substance which is intended to become active substantially during the final rinse cycle of the dishwasher and at least one substance which prevents lime scale deposits in the dishwasher and/or on the washed articles; and means to ensure that at least the substance which is intended to become active substantially during the final rinse cycle of the dishwasher is not released, at least predominantly, until the start of the final rinse cycle at the earliest.

The substances in the separately arranged region may be mixed with one another.

By particular preference, the substances in the separately arranged region are divided into two part-regions, specifically so that the substance(s) intended to become active substantially in the final rinse cycle of the dishwasher is (are) in one part-region and the substance(s) intended to prevent lime scale deposits in the dishwasher and/or on the washed articles is (are) in the other part-region.

By particular preference, the region(s) has/have a core, essentially containing the substance intended to become active substantially during the final rinse cycle of the dishwasher; and a shell around this core contains the substance which prevents lime scale deposits in the dishwasher and/or on the washed articles.

A dividing layer that is substantially impermeable to the substances is preferably provided between the two part-regions.

By particular preference, the means (for preventing premature release of the final rinse substance) comprise an appropriate coating, containing at least one compound of which the solubility increases as the concentration of a specific ion in the ambient medium decreases.

In a second alternative, the objective of the invention is achieved by means of a generic composition, which is characterized by a base composition in the form of a tablet which is active in the main washing cycle of the dishwasher; two regions arranged separately in or on the tablet, of which a first region contains at least one substance intended to become active substantially in the final rinse cycle of the dishwasher and a second region containing at least one substance which prevents lime scale deposits in the dishwasher and/or on the washed articles; and respectively a coating essentially completely enclosing the regions and containing at least one compound, the solubility of which increases as the concentration of a specific ion in the ambient medium decreases.

For both alternatives, it is preferable to provide means to ensure that the substance(s) for preventing lime scale deposits in the dishwasher and/or on the washed articles is (are) at least partially released prior to the final rinse cycle.

The invention further proposes that an additional water-soluble protective coating be provided as the outermost layer.

Moreover, the substance for preventing lime scale deposits is a substance which is capable of forming a complex, in particular a substance selected from the group consisting of phosphonates and polymers, in which case the polymers are preferably polyacrylates or copolymers thereof.

Alternatively, the substance for preventing lime scale deposits is preferably a substance which shifts the carbonate/bicarbonate equilibrium in the washing medium towards bicarbonate, preferably an acid or an acid mixture. Preferably, it is an acid from the group of carboxylic acids, preferably fruit acids, in particular citric acid.

In a preferred embodiment of the invention, the coating contains at least one compound, of which the solubility increases and the pH value in the ambient medium falls as the OH ion concentration decreases.

The composition proposed by the invention is distinctive because it produces outstanding results, both in the main washing cycle and in the final rinse cycle of a dishwasher and also renders the use of an ion exchanger and the use of salt to regenerate it superfluous in most instances (at least in homes with a water hardness up to 35 EdH). The tablet is dissolved during the main washing cycle and can fulfil its intended function accordingly. The region(s) arranged separately on the tablet contain(s) substances with the desired other functions, namely the substance(s) for the final rinse cycle, e.g. rinse agent, on the one hand, and the substance(s) rendering the use of ion exchangers unnecessary.

The substances in the separately arranged region(s) may be protected by a coating, which is stable in the presence of the concentration of a specific ion, e.g. the OH ion, and hence at the prevailing pH value, and at the temperature of the main washing cycle and barely dissolves or disintegrates at all. Not until this concentration is significantly reduced by dilution, e.g. the pH value is shifted towards neutral or acid, i.e. at the earliest at the start of the final rinse cycle, does the solubility of the coating material reduce so sharply that it dissolves or disintegrates rapidly and releases the active core material into the ambient medium.

In addition, the substances may be protected by a component in the coating which has a so-called cloud point. These components are less soluble at high temperatures and afford protection against early release of active substances in applications at high temperatures in the cleaning cycle. Examples of substances with a cloud point of this type are celluloses, some polyacrylate derivatives, etc.

It is of particular benefit to protect any substance(s) which is (are) intended to become active substantially in the final rinse cycle of the dishwasher, such as a rinse agent, for example. This (these) substance(s) should therefore not be released, at least predominantly (i.e. up to more than 50%), until the start of the final rinse cycle. The substance(s) which prevent lime scale deposits in the dishwasher and/or on the washed articles may also be protected by an appropriate coating, for example, to prevent premature release so that this (these) substance(s) is (are) also not released until the final rinse cycle. In a preferred embodiment, however, the substance(s) preventing lime scale deposits is (are) released at an earlier point in time, i.e. prior to the start of the final rinse cycle, so that their action is not only released during the final rinse cycle but also for a longer time during the washing cycle.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
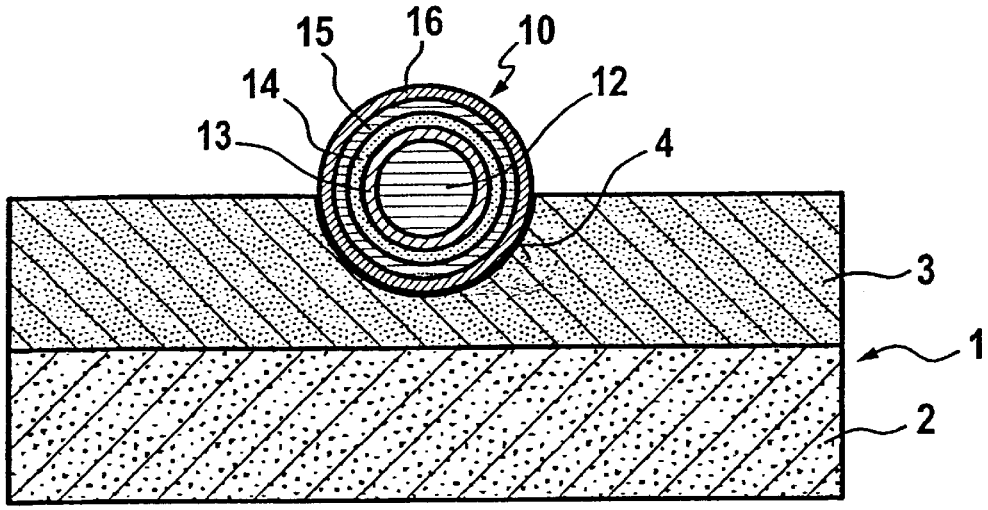
FIG. 1 is a cross section of a first embodiment of the composition proposed by the invention.

FIG. 1 illustrates a tablet 1 in the form of a two-layered tablet with a bottom layer 2 and a top layer 3. One of the standard, commercially available tablets may be used as the base, in which case the two layers will usually be of a different composition and will be of different colors.

A depression 4 is provided in the top layer 3, in which a pellet 10 is accommodated. The (usually separately manufactured) pellet 10 may be secured in the depression 4 by means of an adhesive, for example.

Figure 2:
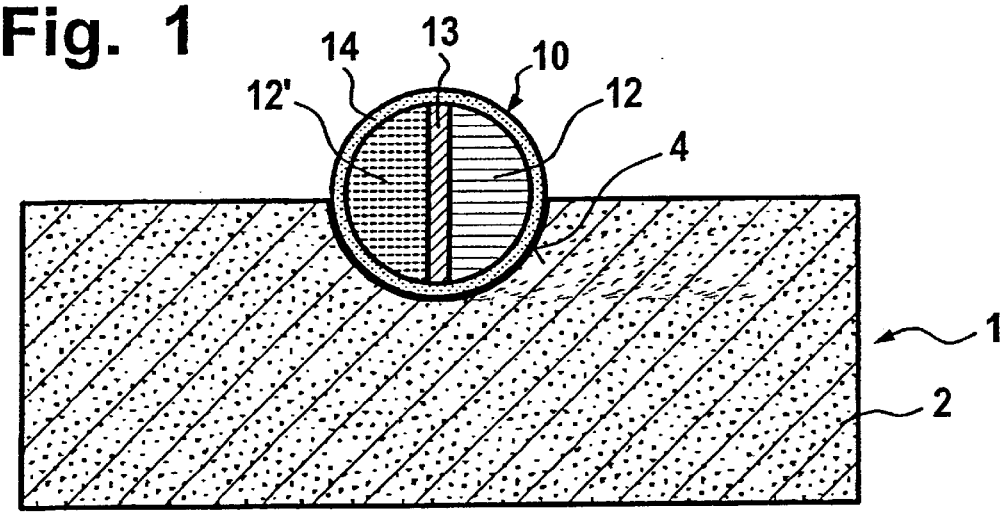
FIG. 2 is a cross section of a second embodiment of the composition proposed by the invention.
Figure 3:
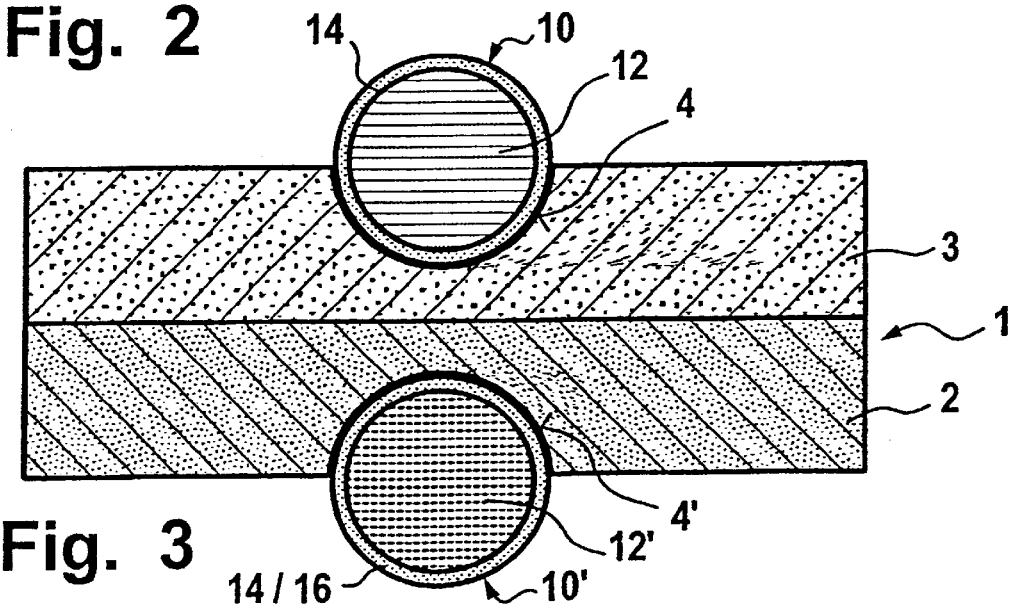
FIG. 3 is a cross section of a third embodiment of the composition proposed by the invention.

In the embodiment illustrated, the pellet 10 is a core 12 with a multi-layered coating (13, 14, 15, 16), although it should be pointed out that in this diagram and the diagrams of FIG. 2 and FIG. 3 the drawings are not shown to the correct scale in order to retain clarity.

In the embodiment illustrated in FIG. 1, the core 12 of the pellet 10 contains the substance(s) which exhibit(s) their main action substantially during the final rinse cycle of the dishwasher, e.g. one or more surfactants which may be used as rinse agents. This rinse agent core 12 is encased in a first dividing layer 13, consisting of a water-soluble material which is substantially impermeable to the substances of the core 12, but which is able to dissolve rapidly during the final rinse cycle of the dishwasher in order to release the substances from the core 12.

Around this casing 13 is another coating 14, the structure of which is such that it does not substantially dissolve until the start of the final rinse cycle. To this end, it contains at least one compound having a solubility which increases as the concentration of a specific ion in the ambient medium decreases.

In the simplest situation, the solubility may be linked to a decreasing concentration of the OH ion and hence a decreasing pH value. Examples of compounds of this type are described in German published patent application DE 198 34 180 A1, the full disclosure of which is therefore explicitly included in this application.

An example of a coating material listed in this German patent application is the polymer described in Japanese published patent application (Kokai) 61-28440 having the following formula, in which 1/(1+m+n)=0.35; m/(1+m+n)=0.45; 1+m+n=1,500 to 1,800.

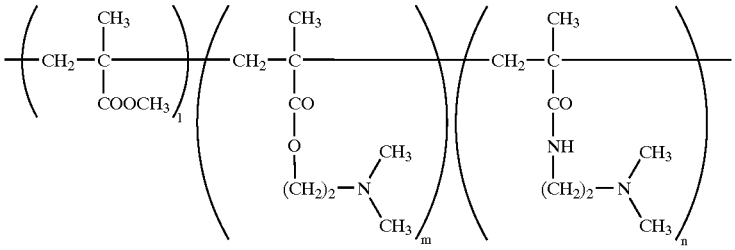

Other examples cited in DE 198 34 180 A1 are the other polymers named in Japanese published patent applications (Kokai) 60-141705, 61-28440, 61-28441, 61-28596, 61-28597 and 61-28598.

Another pH-sensitive polymer with the repeat unit II

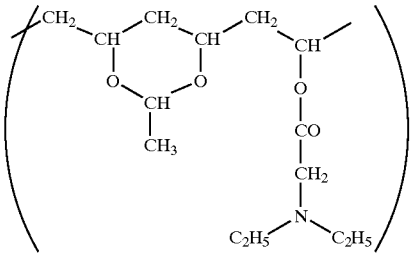

is sold by Sankyo under the registered name of AEA7.

Other polymers which are suitable for the purposes of the present invention are polymers of isomers or derivatives of pyridine, preferably copolymers with styrene or acrylonitrile having formula III and IV below, in which G represents a substituent at any point of the pyridine ring.

(III)

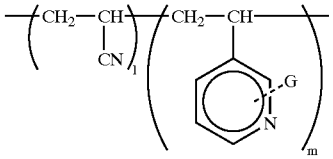

(IV)

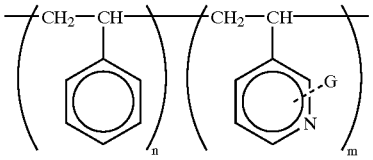

and (e.g. static) polymers derived from chitosan, based on the following monomer units V and VI (V)

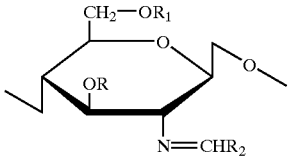

-continued (VI)

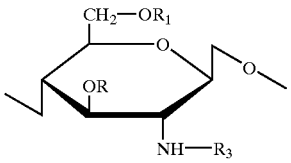

An example of a polymer that is sensitive to ion concentration is the polysaccharide κ-carrageenan having formula VI below

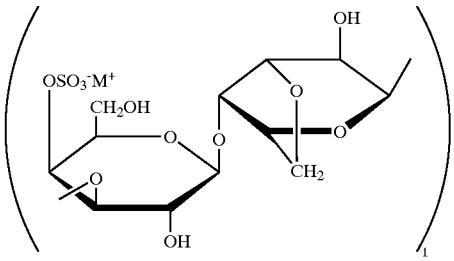

being a polymer dependent on the concentration of potassium ions in the ambient medium.

Naturally, the substances which may be used in the coating 14 are not restricted to those described above and include all known and suitable compounds having the requisite functionality.

Around this coating 14 is a shell 15, which contains the second functional substance for the final rinse cycle, namely the substance intended to prevent deposits of lime scale in the dishwasher and on the washed articles, such as one of the substances mentioned above, for example, i.e. either a chelating agent such as phosphonate or polymer, or a substance which imparts sufficient acidity to shift the carbonate/bicarbonate equilibrium towards bicarbonate in order to prevent deposits of carbonate in the dishwasher and on the washed articles, for example a fruit acid such as citric acid.

The outermost layer may be another water-soluble protective coating 16 to protect the pellet 10 during storage and transportation.

The protective coating 16 is dissolved as the tablet dissolves, essentially as early as the main wash cycle of the dishwasher.

As an alternative to this embodiment, both the component serving as an active rinse agent and the component preventing lime scale may be combined (at least partially) in the core 12. In this embodiment, the shell 15 is no longer necessary but may be provided in addition as a substrate for additional quantities of the lime scale-preventing component and/or an (optional additional) active component for preventing deposits.

FIG. 2 illustrates another embodiment of the composition proposed by the invention in the form of a tablet 1, which in this case consists of a single layer 2, in which—as in FIG. 1—a depression 4 is provided to accommodate an appropriate dual-function pellet. In this case, the core consists of two half-cores 12, 12', a first core 12 containing the substance with the one functionality and the second half-core 12' the substance with the other functionality. By preference, the two half-cores are separated by a dividing layer 13, which may correspond to the dividing layer 13 described in relation to FIG. 1 in terms of its composition. This is particularly practical if the substances in the half-cores are not compatible with one another. The core 12, 12' is enclosed by the coating 14, which ensures that the ingredients of the core are not released until the final rinse cycle. In this embodiment, therefore, both substances, i.e. rinse agent substance and lime scale-preventing substance, are not released until the final rinse cycle. For the sake of clarity, the other protective coating 16 has been left out of the drawing.

FIG. 3 illustrates another alternative of the composition proposed by the invention in which the tablet 1—as in FIG. 1—again consists of two layers, a bottom layer 2 and a top layer 3. In this case, however, a depression 4 and 4' is provided in each of the two layers, to accommodate pellets 10 and 10' accordingly. The cores 12 and 12' of the pellets 10 and 10' are selected so that the one core (for example 12) contains the substance which becomes active substantially in the final rinse cycle, e.g. a rinse agent in the form of a surfactant, while the other core (12') contains the substance to prevent lime scale deposits in the dishwasher and on the washed articles, for example a chelating agent such as phosphonates or appropriate polymers or an acid-imparting agent such as citric acid. While core 12 is encased in a coating 14 as before, preferably but not necessarily of the same material and intended—as described above—to ensure that the substance contained in the core is not released until the final rinse cycle, the core 12' may be surrounded by nothing more than a protective coating 16 as described above. Naturally, the core 12' could also be enclosed in the same coating 14 as core 12.

The described pellets may be made either by a pressing process or by any other manufacturing method. If two or more pellets are used, as is the case described with reference to FIG. 3 or the embodiment described below with reference to FIG. 4, the pellets may also naturally be made by different methods.

Figure 4:
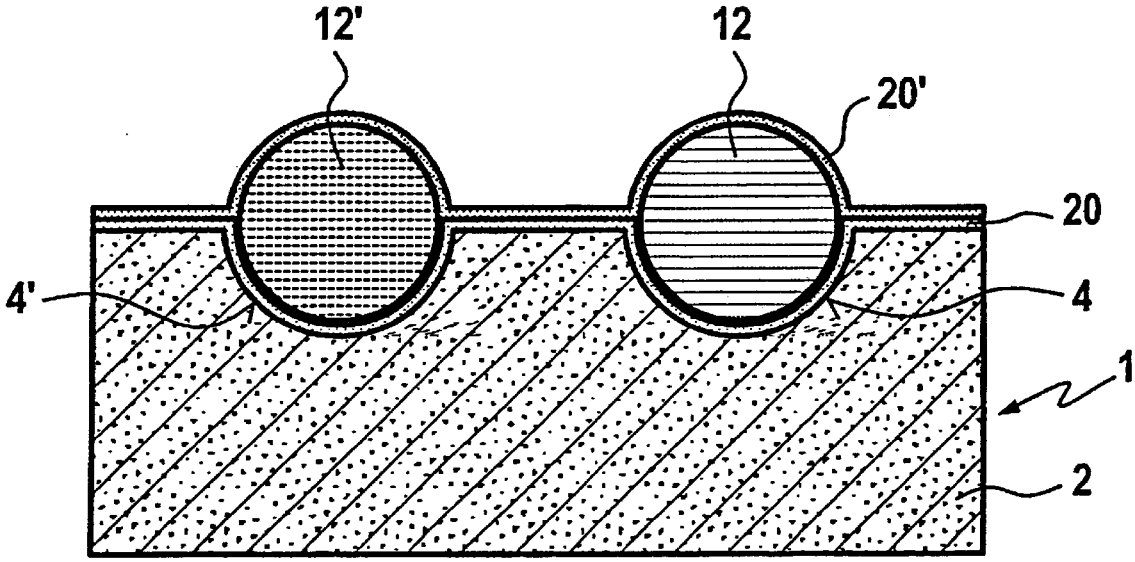
FIG. 4 is a cross section of a fourth embodiment of the composition proposed by the invention.

FIG. 4, finally, illustrates another alternative of the composition proposed by the invention. Tablet 1, consisting of a single layer 2, has two depressions 4, 4' in a top face. The face with the depressions 4 and 4' is then coated with a film 20, for example of one of the materials used for the protective coating 14 described in respect of the embodiments above. Depression 4 is filled with a material 12 which acts as a rinse agent and depression 4' with a lime scale-preventing material 12'. The materials 12 and 12' may be molded in the form of a ball—as with the above embodiments—or may alternatively be used in the form of powdered compositions or viscous, gel-type compositions. Another film 20' is then applied on top, which may be of the same or a similar formula as film 20. The rinse agent material 12 and the lime scale-preventing material 12' are therefore completely encased in a protective coating (and/or are both not released until the final rinse cycle).

For other possible designs of tablets with pellets arranged therein or thereon and additional details about the composition and manufacture of a rinse agent pellet and coatings sensitive to pH and ion concentration, reference may be made to the above-mentioned German published patent application DE 198 34 180 A1.

EXAMPLE

To provide a further illustration, an example of one possible embodiment will be described below. The formula of the tablet may be that used for a standard two-layered tablet. Core 12 contains rinse agent substances in the form of 57% by weight of polyethylene glycol (molecular weight of approx. 35,000) and 28% by weight of fatty alcohol ethoxylate propoxylate. The substance used to prevent lime scale deposits in the core 12 is 15% by weight of citric acid.

Alternatively, the citric acid may be totally or partially left out of core 12 and totally or partially provided in the coating 14.

Protective coating 15 contains (as a % by weight of the pellet as a whole) 1.3% by weight of the polymer described in more detail above as specified in Japanese patent application (Kokai) 61-28440, 3.0% of hydroxypropyl methyl cellulose and 3.0% of polyvinyl alcohol.

A dividing layer 13 and a protective coating 16 are not provided in this particular instance.

For a standard two-layered tablet, cores with a diameter of approx. 12 mm (1 g) were produced in appropriate devices and coated with the coating materials described above.

The features of the invention disclosed in the description, claims and drawings may essentially be used individually and in any combination to implement the invention in its different embodiments.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A base composition, in the form of a tablet which becomes active substantially in a main wash cycle of a dishwasher, comprising:

at least one separately arranged first region in or on the tablet, wherein the first region comprises at least one substance intended to become active substantially during a final rinse cycle of the dishwasher and at least one substance intended to prevent lime scale deposits in the dishwasher and on washed articles; wherein the first region further comprises an appropriate coating comprising at least one compound of which a solubility increases as a concentration of a basic ion in an ambient medium decreases; and the substances contained in the first region are not released, at least predominantly, until the start of the final rinse cycle at the earliest;

wherein the first region comprises at least a first and a second part-region and wherein the substances in the first region are contained in the at least first and second part-regions, and further comprising a dividing layer between the first and second part-regions that is substantially impermeable to the substances.

2. The composition as claimed in claim 1, wherein the at least one substance intended to become active substantially during the final rinse cycle of the dishwasher is contained in the first part-region and wherein the at least one substance intended to prevent lime scale deposits in the dishwasher and on the washed articles is contained in the second part-region.

3. The composition as claimed in claim 1, wherein the first region further comprises a core, essentially comprising the at least one substance intended to become active substantially during the final rinse cycle of the dishwasher; and a shell around the core comprising the at least one substance intended to prevent lime scale deposits in the dishwasher and on the washed articles.

4. The composition as claimed in claim 1, further comprising a means for ensuring that the at least one substance intended to prevent lime scale deposits in the dishwasher and on the washed articles is released at least partially prior to the final rinse cycle.

5. The composition as claimed in claim 1, wherein the first region further comprises an outermost layer comprising an additional water-soluble protective coating.

6. The composition as claimed in claim 1, wherein the substance intended to prevent lime scale deposits comprises a substance capable of forming a complex.

7. The composition as claimed in claim 6, wherein the substance is selected from the group consisting of a phosphonate and a polymer.

8. The composition as claimed in claim 7, wherein the polymer comprises a polyacrylate or a copolymer thereof.

9. The composition as claimed in claim 1, wherein the substance intended to prevent lime scale deposits comprises a substance which shifts a carbonate/bicarbonate equilibrium in a rinsing medium towards bicarbonate.

10. The composition as claimed in claim 9, wherein the substance comprises an acid or an acid mixture.

11. The composition as claimed in claim 10, wherein the acid comprises a carboxylic acid.

12. The composition as claimed in claim 11, wherein the acid comprises a fruit acid.

13. The composition as claimed in claim 12, wherein the fruit acid comprises citric acid.

14. The composition as claimed in claim 1, wherein the coating comprises at least one compound of which the solubility increases as an OH ion concentration decreases and a pH value in the ambient medium falls.

15. A base composition, in the form of a tablet which becomes active substantially in a main wash cycle of a dishwasher, comprising:

at least one separately arranged first region in or on the tablet, wherein the first region comprises at least one substance intended to become active substantially during a final rinse cycle of the dishwasher and at least one substance intended to prevent lime scale deposits in the dishwasher and on washed articles; wherein the first region further comprises an appropriate coating comprising at least one compound of which a solubility increases as a concentration of a basic ion in an ambient medium decreases; and the substances contained in the first region are not released, at least predominantly, until the start of the final rinse cycle at the earliest;

wherein the first region further comprises a core, essentially comprising the at least one substance intended to become active substantially during the final rinse cycle of the dishwasher; and a shell around the core, comprising the at least one substance intended to prevent lime scale deposits in the dishwasher and on the washed articles.

16. The composition as claimed in claim 15, further comprising a dividing layer between the core and the shell that is substantially impermeable to the substances.

17. The composition as claimed in claim 15, further comprising a means for ensuring that the at least one substance intended to prevent lime scale deposits in the dishwasher and on the washed articles is released at least partially prior to the final rinse cycle.

18. The composition as claimed in claim 15, wherein the first region further comprises an outermost layer comprising an additional water-soluble protective coating.

19. The composition as claimed in claim 15, wherein the substance intended to prevent lime scale deposits comprises a substance capable of forming a complex.

20. The composition as claimed in claim 19, wherein the substance is selected from the group consisting of a phosphonate and a polymer.

21. The composition as claimed in claim 20, wherein the polymer comprises a polyacrylate or a copolymer thereof.

22. The composition as claimed in claim 15, wherein the substance intended to prevent lime scale deposits comprises a substance which shifts a carbonate/bicarbonate equilibrium in a rinsing medium towards bicarbonate.

23. The composition as claimed in claim 22, wherein the substance comprises an acid or an acid mixture.

24. The composition as claimed in claim 23, wherein the acid comprises a carboxylic acid.

25. The composition as claimed in claim 24, wherein the acid comprises a fruit acid.

26. The composition as claimed in claim 25, wherein the fruit acid comprises citric acid.

27. The composition as claimed in claim 15, wherein the coating comprises at least one compound of which the solubility increases as an OH ion concentration decreases and a pH value in the ambient medium falls.

* * * * *